US006174384B1

(12) United States Patent
Oikawa et al.

(10) Patent No.: US 6,174,384 B1
(45) Date of Patent: Jan. 16, 2001

(54) MEDIUM-CARBON STEEL HAVING DISPERSED FINE GRAPHITE STRUCTURE AND METHOD FOR THE MANUFACTURE THEREOF

(75) Inventors: Katsunari Oikawa; Toshihiko Abe; Shin-Ichi Sumi, all of Miyagi-ken (JP)

(73) Assignee: Agency of Industrial Science and Technology, Tokyo (JP)

( * ) Notice: Under 35 U.S.C. 154(b), the term of this patent shall be extended for 0 days.

(21) Appl. No.: 09/382,346

(22) Filed: Aug. 25, 1999

(30) Foreign Application Priority Data

Oct. 15, 1998 (JP) ..... 10-314120

(51) Int. Cl.[7] ..... C21D 8/00; C21D 5/14; C21D 6/00; C22C 38/02; C22C 38/14

(52) U.S. Cl. ..... 148/320; 148/328; 148/654; 148/659; 148/660; 148/662

(58) Field of Search ..... 420/125; 148/320, 148/654, 659, 660, 662, 328

(56) References Cited

U.S. PATENT DOCUMENTS 5,156,691 10/1992 Hollenberg et al. ..... 148/663

FOREIGN PATENT DOCUMENTS 8-291366 3/1986 (JP) .
10-072639 7/1988 (JP) .
10-140281 11/1990 (JP) .
3-140411 6/1991 (JP) .
7-188846 7/1996 (JP) .

OTHER PUBLICATIONS

English Abstract of the Japanese publication No. 07–188846, Jul. 9,1996.
English Abstract of the Japanese publication No. 08–291366, Mar. 20, 1986.
English Abstract of the Japanese publication No. 10–072639, Nov. 22, 1990.
English Abstract of the Japanese publication No. 10–140281, Jun. 12, 1991.
Sato et al., "Study of Graphite Steel (1st Report), Effect of Silicon on Graphite Steel", J. Jpn. Inst. Met., vol. 20, pp. 5–9, Jul. 1955.
Yamanaka et al., "On the Mechanism of Graphitization of High–Carbon Steel", Iron & Steel, vol. 8, pp. 946–953, Aug. 1962.
Sueyoshi et al., "Effects of Alloying Elements on the Graphitization of Hypo–Eutecoid Steel", J. Jpn. Inst. Met., vol. 43, pp. 333–339, Oct. 1978.
Okamoto, "Graphite Formation in High–Purity Cold–Rolled Carbon Steels", Metallurgical Transactions A, vol. 20A, pp. 1917–1925, Oct. 1989.
Iwamoto et al., "Effects of B, Al and Rare Earth Metals on Graphitization in 0.53%C Steel", CAMP–ISIJ, vol. 8, p. 1378, 1995.

(List continued on next page.)

*Primary Examiner*—Deborah Yee
(74) *Attorney, Agent, or Firm*—Howson and Howson

(57) ABSTRACT

A medium-carbon steel is provided having a dispersed fine spherical graphite structure, having high mechanical strength, good processability, and good machinability, and having fine ZrC functioning as nucleation sites for graphite. The medium-carbon steel having a dispersed fine spherical graphite structure is manufactured by providing a composition containing 0.1 to 1.5% Si, 1.0% or less C, and 0.01 to 0.5% Zr. After the composition or a material of the composition (ingot) has been hot-rolled, or after the hot-rolled steel has been heat-treated at 750 to 1300° C. for 0.5 to 10 hours (solution heat treatment) after hot-rolling, or after the hot-rolled and heat-treated steel has further been water-quenched to deposit fine ZrC particles in the matrix, the steel is subjected to graphitization treatment by heat-treating at a temperature of 740° C. or below for 0.5 to 100 hours to grow graphite using ZrC as the nucleation site.

13 Claims, 9 Drawing Sheets

OTHER PUBLICATIONS

Two page English translation of select pertinent portions of Japanese publication No. 07–188846, Jul. 9, 1996.

Three page English translation of select pertinent portions of Japanese publication No. 08–291366, Mar. 20, 1986.

Four page English translation of select pertinent portions of Japanese publication No. 10–140281, Nov. 22, 1990.

PATTERN 1

PATTERN 2

PATTERN 3

MEDIUM-CARBON STEEL HAVING DISPERSED FINE GRAPHITE STRUCTURE AND METHOD FOR THE MANUFACTURE THEREOF

FIELD OF THE INVENTION

The present invention relates to a medium-carbon steel with a dispersed fine spherical graphite structure, having high mechanical strength, good processability, and good machinability, enabling the time required for graphitization to be reduced, and lowering the temperature required for the graphitization heat treatment. The present invention also relates to a method of manufacturing a medium-carbon steel.

BACKGROUND OF THE INVENTION

Heretofore, lead steel has been used as a steel material having free-cutting properties. However, since lead free-cutting steel contains Pb, the problem of environmental contamination has arisen, and recently, the use of lead free-cutting steel has been restricted. For this reason, the development of new iron and steel materials posing no environmental problems which replace lead free-cutting steel is desirable.

Under such a situation, although grarphite-dispersed material is known as an iron and steel material having free-cutting properties, it has not been considered as a material having sufficient properties as free-cutting steel, because conventionally considered graphite steel has poor mechanical properties, such as, strength and processability. Therefore, the development of graphite steel which has fine graphite particles evenly dispersed therein and which has free-cutting properties and good mechanical properties is desirable.

In general, it is known that graphitization proceeds readily in high-carbon steel having a hyper-eutectoid composition. Specifically, it has been disclosed that the addition of 1% or more silicon significantly accelerates graphitization. For example, see: Tomo-o Sato et al., "Study on Graphitic Steel (1st Report) Effect of Silicon on Graphitic Steel", J. Jpn. Inst. Met., 1956, Vol. 20, pp. 5–9.

Similarly, it has been disclosed that the graphitization of high-carbon steel is accelerated by quenching, cold working, or by the addition of Al, Si, Ni, Ti, Zr, or B. For example, see: Naomichi Yamanaka et al., "On the Mechanism of Graphitization of High-Carbon Steel", Iron & Steel, 1962, Vol. 8, pp. 946–953.

The Yamanaka reference discloses that the addition of Ti causes acceleration of graphitization since the distribution of Ti in cementite is quite low, and special carbide, TiC, is easily formed. Thus, graphitization is accelerated by the effect of denitrification by Ti rather than the effect of stabilization of cementite.

However, all of these examples are high-carbon steels. For higher strength and better processability, a medium-carbon steel having a C concentration of 1.0% or below is required. Therefore, the above examples are not satisfactory or suitable as a free-cutting steel.

On the contrary, it is the present state that the graphitization of medium-carbon steels, especially hypo-eutectoid steel is difficult, and that the behaviors of graphitization by heat treatment or the addition of alloys have not been well known.

As the previously mentioned Sato reference discloses, although Si is added as an element for accelerating graphitization, it is considered that the quantity of Si is preferably 1.5% or less, since a large quantity of added Si significantly lowers ductility by solid solution hardening.

Under such a situation, there is a report describing the effects on a graphitization phenomenon of addition of Si and Ni, or Si and Co, together to hypo-eutectoid steel. For instance, see: Hidekazu Sueyoshi et al., "Effect of Alloying Elements on the Graphitization of Hypo-Eutectoid Steel", J. Jpn. Inst. Met., 1979, Vol. 43, pp. 333–339.

However, considering that the materials containing Ni or Co are difficult to recycle and that such added elements are relatively expensive, the addition of these materials is not effective, and it cannot be considered that the process for manufacturing hypo-eutectoid steel in which fine graphite particles are dispersed in a stable manner and with high reproducibility has been established.

It has been known that the graphitization of high-carbon steel is accelerated by cold working before the graphitization treatment. As one of such methods there has been disclosed a method for improving softness and ductility as low-carbon steels to hypo-eutectoid steels. For instance, see: Atsuki Okamoto, "Graphite Formation in High-Purity Cold-Rolled Carbon Steels", Metallurgical Transactions A, October 1989, Vol. 20A, pp. 1917–1925.

By this disclosed method, it is considered that cold rolling is conducted until cementite is divided, and the gaps of dividing (eg. voids) become sites of graphitization.

However, this example has problems in that stringent cold working of 20% or more is required for dividing cementite under the state of poor cold-working properties, and cannot be considered to be a stable manufacturing method.

Furthermore, a method has been proposed for accelerating graphitization by adding B, Al, or a rare-earth metal (REM) such as La and Ce to 0.53% C steel. For instance, see: Iwamoto et al., "Effects of B, Al, and REM on the Graphitization Behavior of 0.53% C Steel", CAMP-ISIJ, 1995, Vol. 8, p. 1378.

Since it has been reported that the average particle diameter of graphite can be decreased to 2.7 $\mu$m according to this method, some effects can be considered. However, in this method, the addition of B and Al together is required for realizing the largest number of graphite particles, and the addition of either one alone cannot realize a large number of graphite particles as shown in FIG. 1 of the previously mentioned Iwamoto reference.

As to steel, since it is not easy to control a small quantity of an added element, and the effect of multiple addition is large, there is a problem that this method is not practical.

A common problem of the above graphitization methods is that graphitization must be performed at a high temperature and takes a long time for processing. Complete graphitization requires a temperature of 700° C. and a time between 10 and 50 hours, significantly lowering the manufacturing efficiency.

OBJECTS OF THE INVENTION

For these reasons, the present invention provides a medium-carbon steel which has a dispersed fine spherical graphite structure allowing fine ZrC particles to function as graphite nucleation sites, which has high reproducibility and high productivity, which has high mechanical strength, good processability and machinability, and which enables a reduction in time required for graphitization.

It is also an object of the present invention to provide a novel and efficient method for manufacturing such a medium-carbon steel.

SUMMARY OF THE INVENTION

According to the present invention, a medium-carbon steel is provided comprising a dispersed fine spherical graphite structure containing 0.1 to 1.5% Si, 1.0% or less of C, and 0.01 to 0.5% Zr.

According to other aspects of the present invention, the fine ZrC function as graphite nucleation sites, cementite disappears, and preferably, the structure is a ferrite matrix having 30 to 6500/mm$^2$ of graphite particles with an average diameter of 1 to 20 $\mu$m dispersed therein.

According to another aspect of the present invention, a method for manufacturing a medium-carbon steel is provided. The method includes heat-treating a material of a medium-carbon steel composition having a matrix containing 0.1 to 1.5% Si, 1.0% or less of C, and 0.01 to 0.5% Zr at a temperature of 750 to 1300° C. for 0.5 to 10 hours and quenching the heat-treated material in water to deposit fine ZrC particles in the matrix. Preferably, the method also includes the step of heat treating the quenched material at a temperature of no greater than 740° C. for 0.5 to 100 hours to provide a graphitization treatment to the material to grow graphite using ZrC as nucleation sites. Preferably, the graphitization treatment is performed at a temperature of 450 to 700° C.

According to yet another aspect of the present invention, a method for manufacturing a medium-carbon steel having a dispersed fine spherical graphite structure is provided. The method includes hot-rolling a material of a medium-carbon steel composition containing 0.1 to 1.5% Si, 1.0% or less of C, and 0.01 to 0.5% Zr, air cooling the hot-rolled material, and heat treating the material at a temperature of no greater than 740° C. for 0.5 to 100 hours, after cooling, to provide a graphitization treatment to the material to grow graphite. Preferably, the graphitization treatment is performed at a temperature of 450 to 700° C. In addition, preferably the material is heat-treated, after hot-rolling and before cooling, at a temperature of 750 to 1300° C. for 0.5 to 10 hours.

DETAILED DESCRIPTION OF THE PREFERRED EMBODIMENTS

In the present invention, the Si concentration is determined to be 1.5% (all the concentrations herein are expressed in mass percentage) for preventing embrittlement due to the solid solution of Si. Also, considering the recycling of iron and steel materials, a trace amount of elements posing no recycling problems is added, and fine graphite particles are deposited in medium-carbon steel without stringent processing for shortening the time require for graphitization.

Since non-metallic inclusions present in an iron and steel affect the various properties of the material, many investigations for removing them are conducted. In the present invention, however, studies were conducted focusing on the use of fine particles of 1 $\mu$m or smaller as nucleation sites of solid phase transformation after solidification.

In the present invention, Zr, one of the elements having the strongest trend of carbide formation in Fe is selected, and ZrC is used as the graphite formation site.

The present inventors previously proposed, in Japanese Patent Application No. 10-067900, a hypo-eutectoid steel comprising a dispersed fine graphite structure and a method for its manufacture by adding Ti to a material having a composition of a hypo-eutectoid steel to make the fine TiC function as the nucleation site of graphite. According to the above application, significant improvement has been found in the formation of microstructure of graphite.

The present invention has an effect greater than the above-described steel having a fine graphite structure by the addition of Ti.

Specifically, since Zr used in the present invention significantly tends to link with C, and the solubility product constant of ZrC against the matrix is smaller than that of TiC, ZrC can be deposited by the addition of a smaller quantity of Zr. Also, the addition of Zr has a feature of high graphitization speed, which is greatly advantageous from the point of view of energy consumption in heat treatment.

As described above, the present invention has advantageous features in that the quantity of Zr to be added is extremely small, and a finer graphite structure can be rapidly formed.

The basic component of the present invention is a medium-carbon steel having a C concentration of 0.3 to 1.0%.

The minimum quantity of Zr required for depositing ZrC is 0.01%, and the upper limit of the quantity of Zr is 0.5% in order to prevent the deposition of coarse graphite particles and to prevent extreme decrease in the quantity of graphite particles. That is, the medium-carbon steel of the present invention contains 0.01 to 0.5% Zr.

The minimum quantity of Si required for accelerating graphitization is 0.1%, and the upper limit of the quantity of Si is 1.5% in order to improve cold-working properties and to improve machinability.

Figure 1:
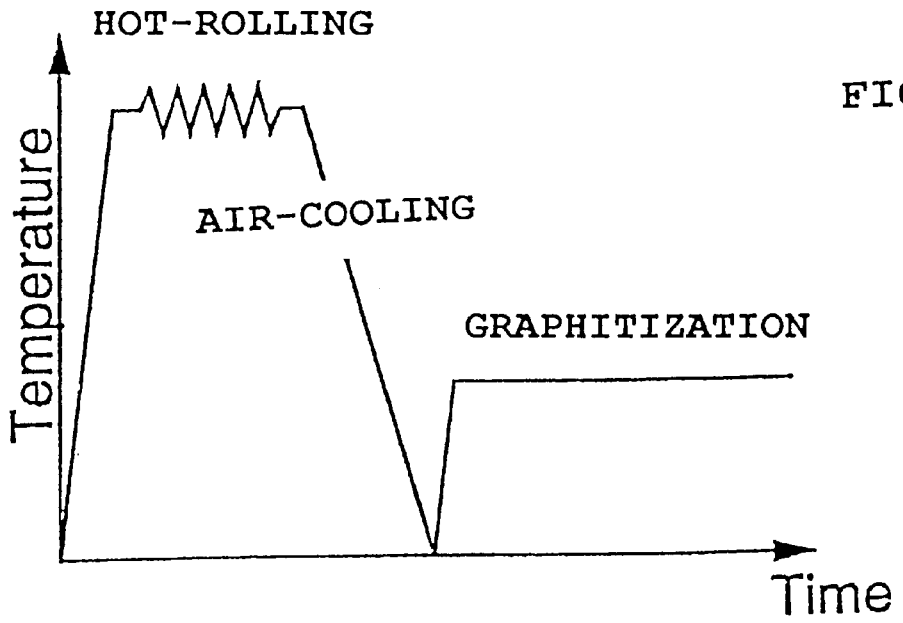
FIG. 1 is a graph titled "Pattern 1" showing the heat treatment schedule of a steel hot-rolled, air-cooled, and graphitized at 450 to 700° C.
Figure 2:
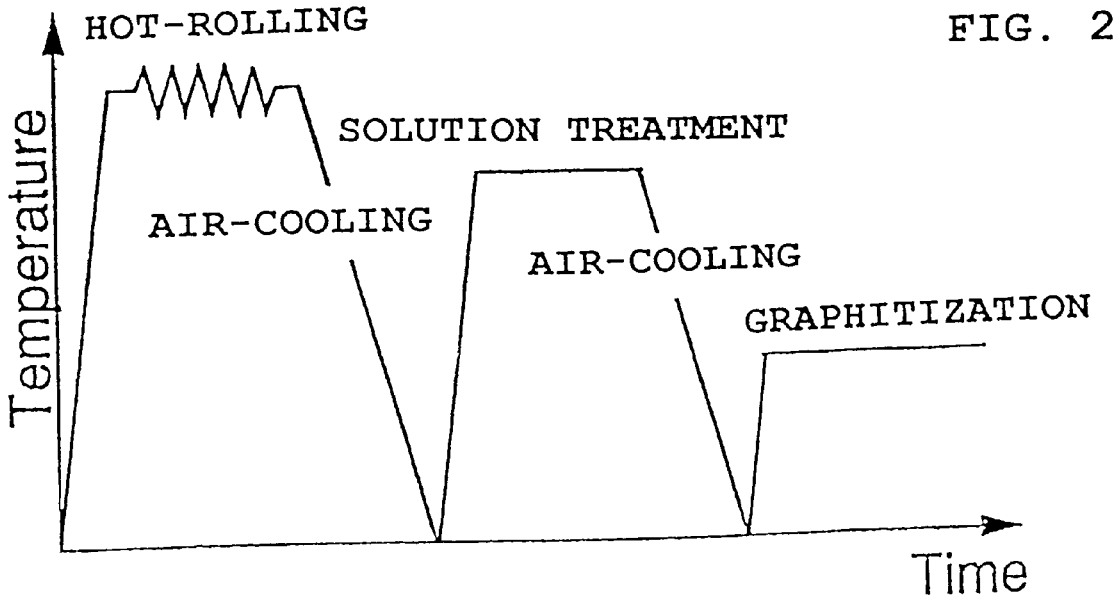
FIG. 2 is a graph titled "Pattern 2" showing the heat treatment schedule of a steel hot-rolled, air-cooled, subjected to solution heat treatment, and graphitized at 450 to 700° C.
Figure 3:
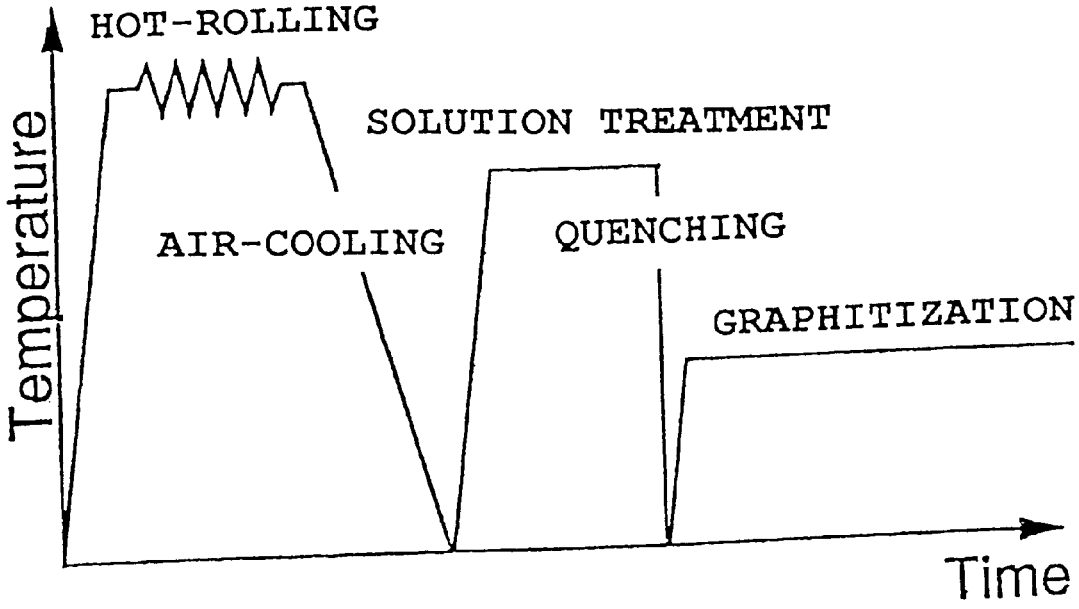
FIG. 3 is a graph titled "Pattern 3" showing the heat treatment schedule of a steel hot-rolled, air-cooled, subjected to solution heat treatment, water-quenched, and graphitized at 450 to 700° C.

According to the present invention, after the material having a composition of medium-carbon steel is melted and cast into an ingot, a medium-carbon steel comprising a dispersed fine spherical graphite structure is manufactured through three types of manufacturing processes (eg. heat treatment histories) shown in FIGS. 1–3.

In Pattern 1 shown in FIG. 1, the material having a composition of medium-carbon steel is melted, cast into an ingot, hot-rolled, cooled in the air, and graphitized for growing graphite by heat treatment at a temperature of no greater than 740° C. for 0.5 to 10 hours, to manufacture a medium-carbon steel comprising a dispersed fine spherical graphite structure.

In Pattern 2 shown in FIG. 2, the material having a composition of medium-carbon steel is melted, cast into an ingot, hot-rolled, cooled in the air, heat-treated at a temperature of 750 to 1300° C. for 0.5 to 10 hours (eg. solution heat treatment), cooled in the air, and graphitized for growing graphite by heat treatment at a temperature of no greater than 740° C. for 0.5 to 10 hours, to manufacture a medium-carbon steel comprising a dispersed fine spherical graphite structure.

In Pattern 3 shown in FIG. 3, the material having a composition of medium-carbon steel is melted, cast into an ingot, hot-rolled, cooled in the air, heat-treated at a temperature of 750 to 1300° C. for 0.5 to 10 hours (eg. solution heat treatment), quenched in water to deposit fine ZrC particles in the matrix, and graphitized for growing graphite by heat treatment at a temperature of no greater than 740° C. for 0.5 to 10 hours using the ZrC particles as nucleation sites, to manufacture a medium-carbon steel comprising a dispersed fine spherical graphite structure.

As described above, by heat treating at a temperature of no greater than 740° C. for 0.5 to 10 hours (or 0.5 to 100 hours if the heat treatment temperature is lower), the graphitization treatment is carried out for growing graphite using the ZrC particles as nucleation sites.

Thereby, cementite disappears, and a medium-carbon steel having a structure in which 30 to 6500 graphite particles of an average particle diameter of 1 to 20 $\mu$m are dispersed in 1 $mm^2$ of the ferrite matrix is obtained.

The size and number of graphite particles vary depending on the composition of Zr, C or the like and the above-described heat-treatment conditions. Therefore, by adjusting these parameters, the size and number of dispersed graphite particles are controlled. In particular, water quenching after heat treatment at a temperature of 750 to 1300° C. for 0.5 to 10 hours (eg. solution heat treatment) is effective for the significant nucleation of graphite and the size reduction of graphite particles.

If the above-described graphitization treatment is performed at a temperature of 450 to 700° C., a larger number of finer graphite particles grow.

A medium-carbon steel, having a structure in which 30 to 6500 graphite particles of an average particle diameter of 1 to 20 $\mu$m are dispersed in 1 $mm^2$ of the ferrite matrix of the medium-carbon steel, has optimal properties for the improvement of cold-working and machinability, and the improvement of mechanical strength.

EXAMPLES AND COMPARATIVE EXAMPLES

The present invention is described referring to Examples as compared to Comparative Examples.

The specimen used in the present invention has a basic composition, which excludes Zr, of 1% Fe and 0.5% Si (mass %, all the concentrations herein are expressed in mass percentage).

In order to deposit ZrC in this basic composition, 0.05 to 0.15% Zr is added, and ingots were melted in a magnesia crucible in an induction furnace. The components used were Fe (99.99%), Si (99.99%), C (99.99%), and ferro-Zr.

After melting, the melts were cast into rod-like ingots each having a diameter of 20 mm, and hot-rolled at 1000° C. to a thickness of 10 mm. These were cut into specimens which have 10 mm square cross sections and which were to be subjected to heat treatment.

In the present invention, three patterns of heat treatments were carried out. The graphs of these three heat treatment histories are illustrated in FIGS. 1–3.

FIG. 1 is a graph showing the heat history when the steel is hot-rolled, air cooled, and graphitized at 450 to 700° C. (Pattern 1).

FIG. 2 is a graph showing the heat history when a steel is hot-rolled, air-cooled, subjected to austenitizing (solution treatment) at 800° C., air cooled, and graphitized at 450 to 700° C. (Pattern 2).

FIG. 3 is a graph showing the heat history when a steel is hot-rolled, air-cooled, subjected to austenitizing (solution treatment) at 800° C., water quenched, and graphitized at 450 to 700° C. (Pattern 3).

After the above described heat treatment, the structure was observed using an optical microscope and an SEM. Before SEM observation of the structure, the surface was mirror-polished and etched with a 10% nitric acid solution.

When graphite was stereoscopically observed, the surface was etched by a controlled potential electrolytic etching method suitable for etching non-metal materials using 1% tetramethyl ammonium-10% acetyl acetone-methyl alcohol before observation.

Air-Cooled Specimens

Figure 4A:
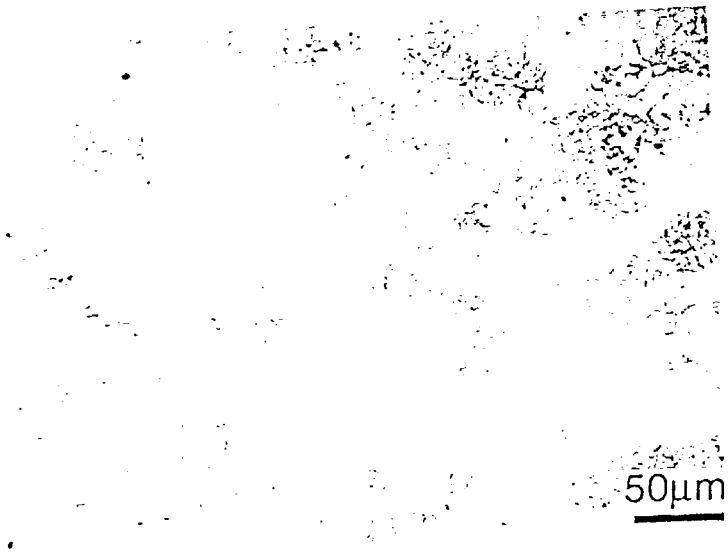
FIG. 4A is an optical micrograph of the structure of a specimen of Fe-1%, Si-0.5%, and C after graphitization at 700° C. for 50 hours under the heat treatment schedule of Pattern 2.
Figure 4B:
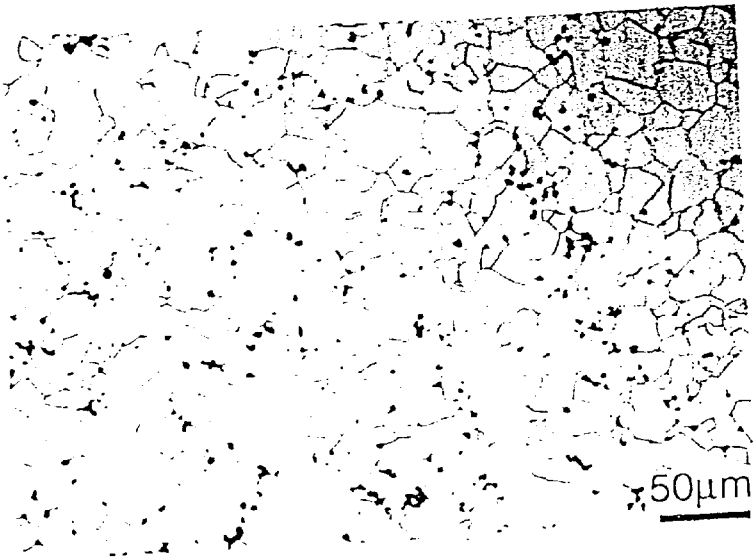
FIG. 4B is an optical micrograph of the structure of a specimen of Fe-1%, Si-0.5%, C-0.05%, and Zr after graphitization at 700° C. for 50 hours under the heat treatment schedule of Pattern 2.
Figure 4C:
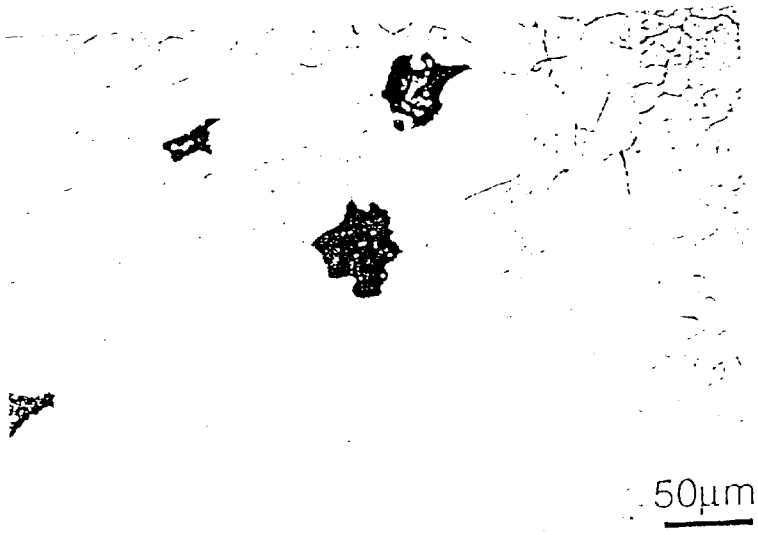
FIG. 4C is an optical micrograph of the structure of a specimen of Fe-1%, Si-0.5%, C-0.15%, and Zr after graphitization at 700° C. for 50 hours under the heat treatment schedule of Pattern 2.

FIGS. 4A, 4B and 4C are optical micrographs of the structures of specimens after heat treatment at 700° C. for 50 hours following solution treatment under the heat history of Pattern 2. The specimen of FIG. 4A has the basic composition, without Zr, of Fe-1%, Si-0.5% and C. The specimen of FIG. 4B has the composition of Fe-1%, Si-0.5%, C-0.05% and Zr. The specimen of FIG. 4C has the composition of Fe-1%, Si-0.5%, C-0.15% and Zr.

In the specimen without Zr, illustrated in FIG. 4A, no graphitization proceeded and cementite particles were dispersed in the ferrite matrix. In addition, no graphitization proceeded in the specimen without Zr even after heat treatment for 400 hours.

In the specimens of FIGS. 4B and 4C, which have 0.05% and 0.15% Zr, respectively, graphitization proceeded. In the case of the specimen of FIG. 4B (0.05% Zr), dispersed graphite particles having a diameter of about 5 μm were observed. In the case of the specimen of FIG. 4C (0.15% Zr), dispersed graphite particles having a diameter of about 15 μm were observed.

Although no optical micrographs are shown for the heat treatment performed according to Pattern 1, similar structures as shown in FIGS. 4A, 4B and 4C were obtained except that slightly less graphitization occurred.

Figure 5A:
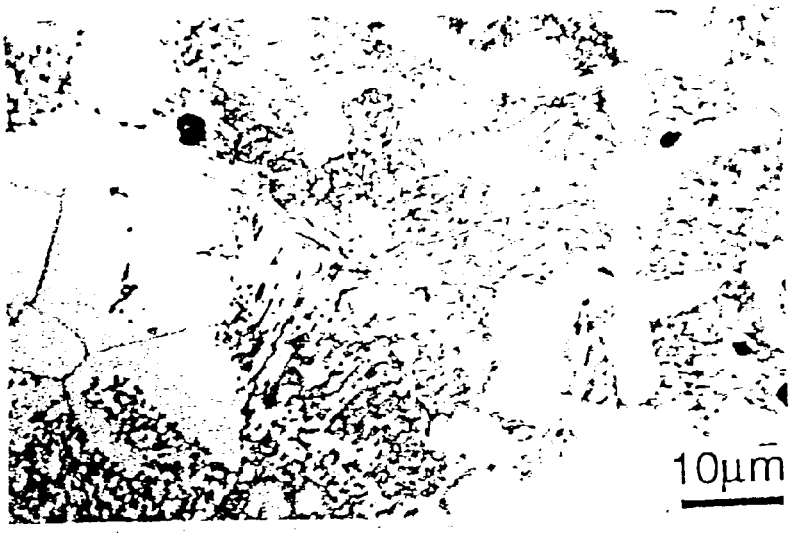
FIG. 5A is an optical micrograph of the structure of a specimen of Fe-1%, Si-0.5%, C-0.05%, and Zr after heat treatment at 700° C. for 1 hour under the heat treatment schedule of Pattern 2.
Figure 5B:
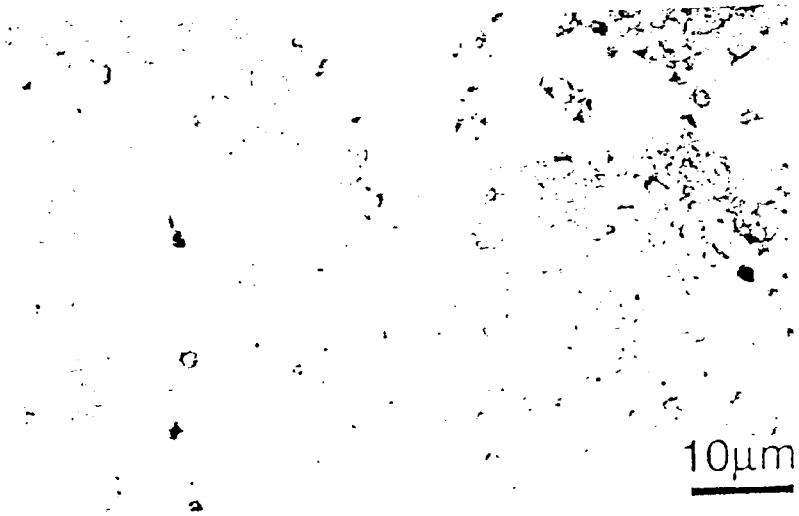
FIG. 5B is an optical micrograph of the structure of a specimen of Fe-1%, Si-0.5%, C-0.05%, and Zr after heat treatment at 700° C. for 1.5 hours under the heat treatment schedule of Pattern 2.
Figure 6A:
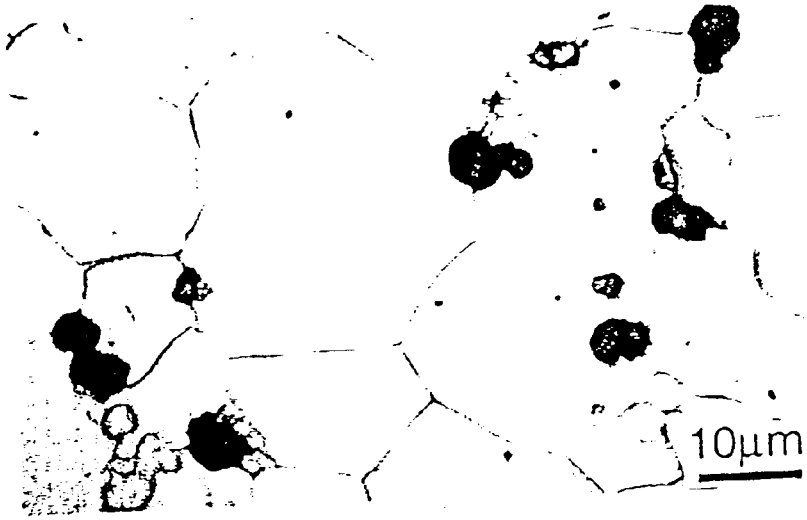
FIG. 6A is an optical micrograph of the structure of a specimen of Fe-1%, Si-0.5%, C-0.05%, and Zr after heat treatment at 700° C. for 2 hours under the heat treatment schedule of Pattern 2.
Figure 6B:
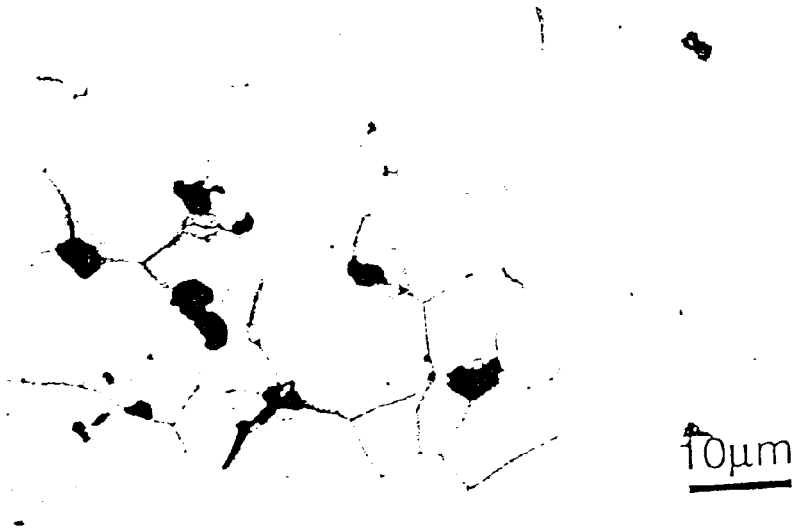
FIG. 6B is an optical micrograph of the structure of a specimen of Fe-1%, Si-0.5%, C-0.05%, and Zr after heat treatment at 700° C. for 30 hours under the heat treatment schedule of Pattern 2.

FIG. 5A shows the optical micrograph of the specimen to which 0.05% Zr has been added, ie. Fe-1%, Si-0.5%, C-0.05% and Zr, when the time for graphitization heat treatment at 700° C. following solution treatment in the heat history of Pattern 2 is 1 hour. Likewise, FIG. 5B, 6A and 6C show the optical micrographs for the above stated specimen when the time for graphitization heat treatment at 700° C. following solution treatment in the heat history of Pattern 2 is 1.5 , 2 and 30 hours, respectively.

As shown in FIG. 5A, nucleation of graphite already partially starts in 1 hour of graphitization treatment. As shown in FIG. 6A, graphitization is completed in 2 hours. Thereafter, the structure of the specimen was substantially unchanged and stabilized even if the heat treatment was continued for a longer time. Therefore, it was determined that after graphitization has completed, heating (ie. graphitization heat treatment) for an unnecessarily long time is economically wasteful.

Figure 7A:
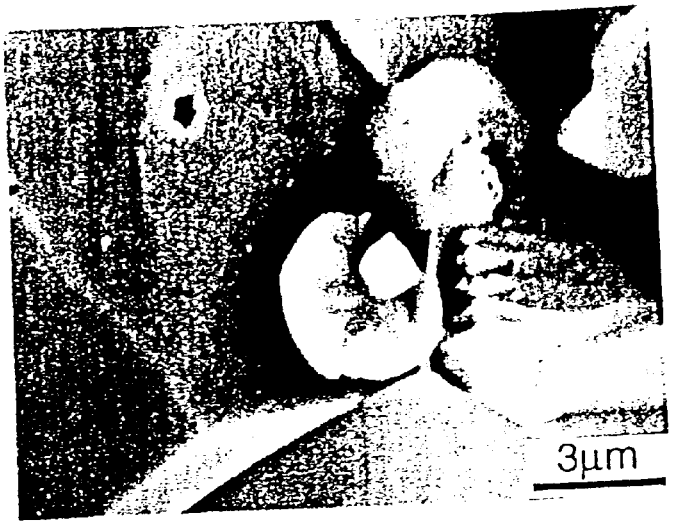
FIGS. 7A, 7B and 7C are SEM photographs of a specimen of Fe-1%, Si-0.5%, C-0.05%, and Zr after graphitization at 700° C. for 1.5 hours under the heat treatment schedule of Pattern 2.
Figure 7B:
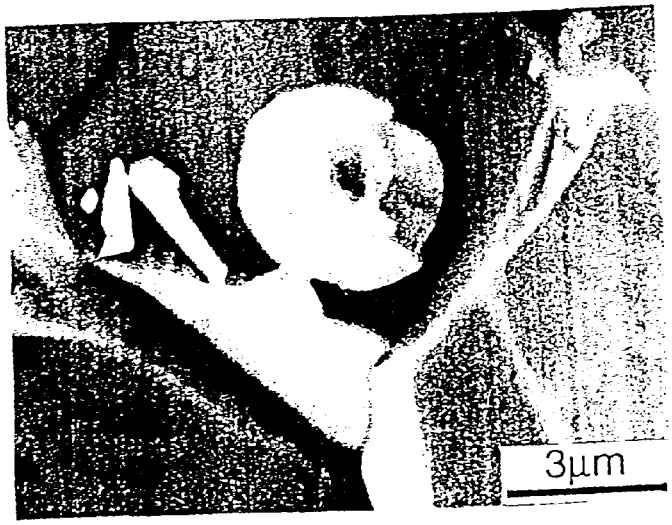
Figure 7C:
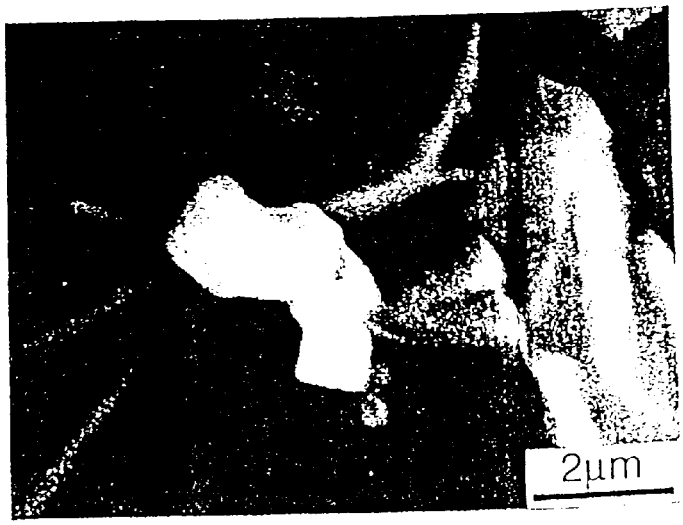

FIGS. 7A, 7B and 7C are SEM photographs of the specimen of Fe-1%, Si-0.5%, C-0.05% and Zr after graphitization at 700° C. for 1.5 hours following solution treatment under the history of Pattern 2, the matrix of which was etched by a controlled potential electrolytic etching method, and graphite was stereoscopically observed. A cubic ZrC of about slightly less than 1 μm from which graphite is growing is observed in substantially the center of each of FIGS. 7A, 7B and 7C. In these micrographs, a spherical matter having a diameter of 2 to 3.5 μm and present in the vicinity of the cubic ZrC is graphite. Therefore, it is shown by these micrographs that the ZrC functions as the nucleation site of the graphite.

Although not shown in the drawings, graphite particles tend to become coarse when Zr concentration increases (eg. in the case of 0.15% Zr). It is considered that since Zr is an element having a strong carbide forming tendency, it has a tendency to prevent the diffusion of carbon atoms in the ferrite matrix and to stabilize cementite when the Zr concentration increases, thereby preventing the nucleation and dispersion of graphite particles on ZrC and increasing the size of graphite particles. Since such increase in the size of graphite particles is contrary to the object of forming dispersed fine graphite particles, unnecessarily increased Zr concentration must be avoided. For the above reason, therefore, the upper limit of Zr concentration is established to be 0.5%.

Figure 8A:
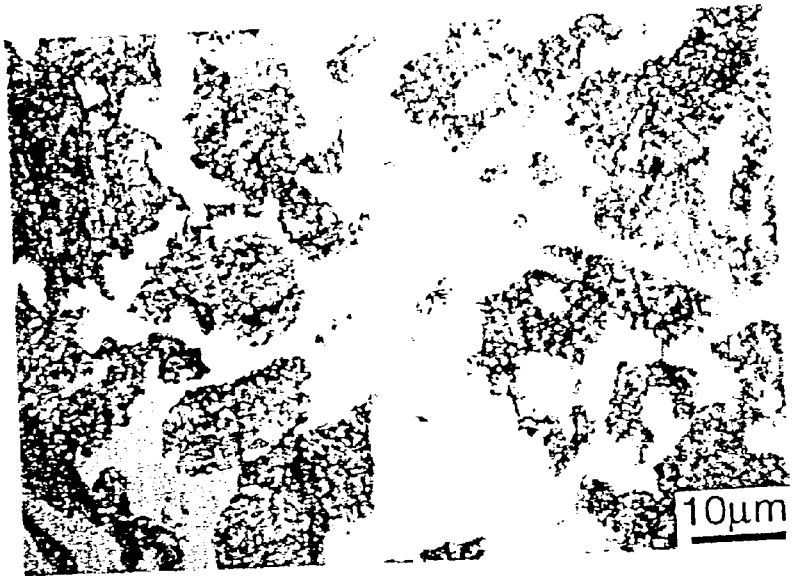
FIG. 8A is an optical micrograph of a specimen of Fe-1%, Si-0.5%, C-0.05%, and Zr after graphitization at 450° C. for 50 hours under the heat treatment schedule of Pattern 2.
Figure 8B:
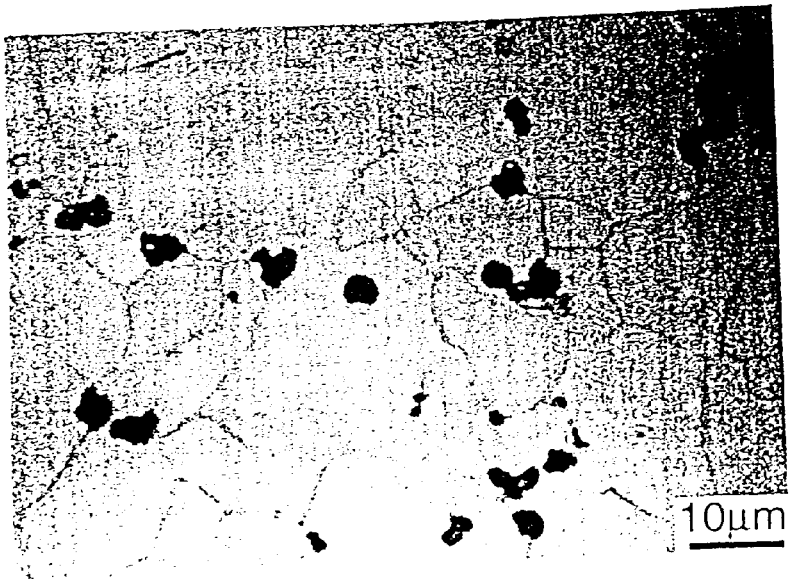
FIG. 8B is an optical micrograph of a specimen of Fe-1%, Si-0.5%, C-0.05%, and Zr after graphitization at 550° C. for 50 hours under the heat treatment schedule of Pattern 2.

FIGS. 8A and 8B are optical micrographs of the specimen of Fe-1%, Si-0.5%, C-0.05%, and Zr showing the results of graphitization after two patterns of graphitization heat treatment at 450° C. and 550° C., respectively, for 50 hours following solution treatment under the heat history of Pattern 2. The specimen shown in FIG. 8A was heated at 450° C. and has no observable graphite particles. The specimen shown in FIG. 8B was heated at 550° C. It is observed to have completion of graphitization. Thus, the above results indicate that the addition of Zr accelerates graphitization and that dispersed fine graphite particles are well formed even at relatively low temperatures, such as 500° C.

The fact that graphitization is possible at such a low temperature has a large impact from the standpoint of manufacturing costs.

Water Quenched Specimens

Figure 9A:
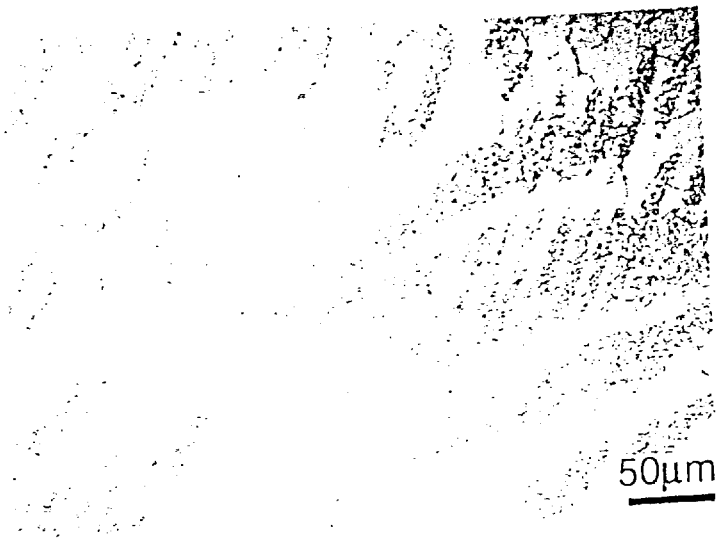
FIG. 9A is an optical micrograph of a specimen of Fe-1%, Si-0.5%, and C after graphitization at 700° C. for 50 hours under the heat treatment schedule of Pattern 3.
Figure 9B:
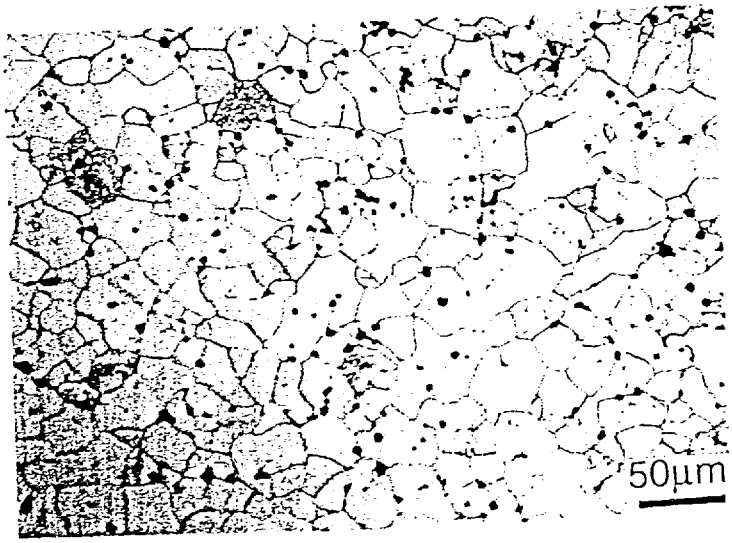
FIG. 9B is an optical micrograph of the structure of a specimen of Fe-1%, Si-0.5%, C-0.05%, and Zr after graphitization at 700° C. for 50 hours under the heat treatment schedule of Pattern 3.
Figure 9C:
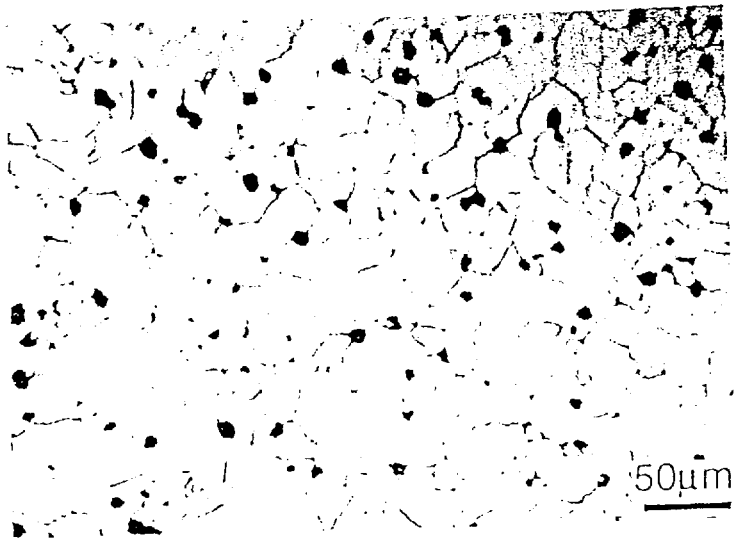
FIG. 9C is an optical micrograph of the structure of a specimen of Fe-1%, Si-0.5%, C-0.15%, and Zr after graphitization at 700° C. for 50 hours under the heat treatment schedule of Pattern 3.

FIGS. 9A, 9B and 9C are optical micrographs of various specimens after graphitization at 700° C. for 50 hours under the heat treatment schedule of Pattern 3. The specimen of FIG. 9A has the basic composition, without Zr, of Fe-1%; Si-0.5% and C. The specimen of FIG. 9B has the composition of Fe-1%; Si-0.5%, C-0.05% and Zr, and the specimen of FIG. 9C has the composition, of Fe-1%; Si-0.5%, C-0.15% and Zr.

In the specimen without Zr, illustrated in FIG. 9A, a structure is observed which has dispersed fine spherical cementite particles and no graphite particles.

In the specimens of FIGS. 9B and 9C, which have 0.05% and 0.15% Zr, respectively, structures are observed in which fine graphite particles of diameters 5 to 10 μm are dispersed in the ferrite matrix. In particular, in the 0.15% Zr specimen, well-shaped (spherical) fine graphite particles are evenly dispersed, and the graphite particles are significantly finer compared with the identical specimen heat-treated according to Pattern 2 and shown in FIG. 4C.

It is considered that the matrix is generally transformed to martensite by quenching, and that a large number of lattice defects are introduced and promote the diffusion of carbon atoms in the matrix which thereby promotes the diffusion of graphite into the vicinity of ZrC to be the nucleation sites of graphite, generating a large number of nuclei of graphite, and forming a fine graphite structure. From the above results, water quenching according to Pattern 3 is found to be extremely effective for causing the formation of dispersed fine graphite particles.

Figure 10A:
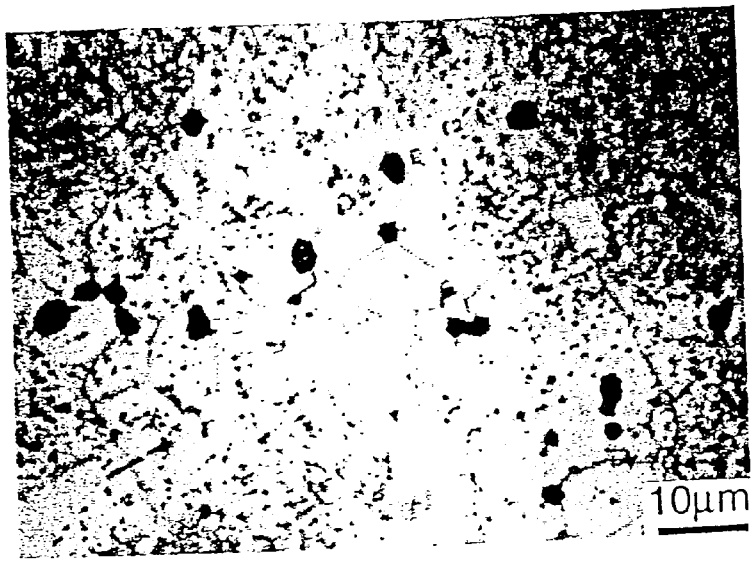
FIGS. 10A and 10B are optical micrographs of the structures of a specimen of Fe-1%, Si-0.5%, C-0.05%, and Zr after graphitization at 700° C. under the heat treatment schedule of Pattern 3.
Figure 10B:
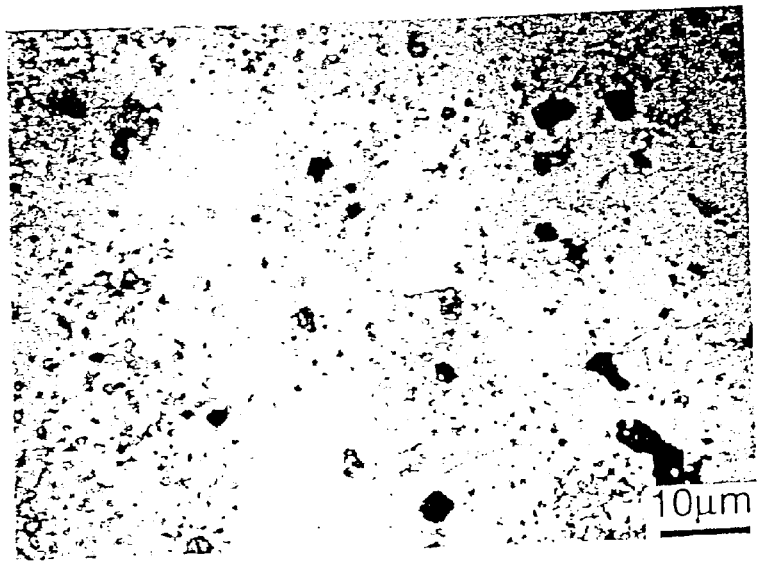

FIGS. 10A and 10B are the optical micrographs of the structures of the specimen of a medium-carbon steel having a composition of Fe-1%; Si-0.5%, C-0.05% and Zr when the time of graphitization heat treatment at 700° C. following solution treatment under the heat schedule of Pattern 3 was 30 minutes and 1 hour, respectively.

As shown by FIG. 10A, graphitization has proceeded considerably after 30 minutes of the graphitization heat treatment. As shown by FIG. 10B, graphitization has almost completed after 1 hour of graphitization heat treatment. When compared with the specimen of FIG. 5 which is a hypo-eutectoid steel of the same composition in which no quenching was performed, it is shown that graphitization has significantly proceeded in the specimen treated according to Pattern 3 in which water-quenching was performed.

From the above description and embodiments, finely and evenly dispersed graphite can be deposited in the matrix of the medium-carbon steel of the present invention by suitably controlling the temperature and time of heat treatment for graphitization corresponding to the content of Zr, and heat treatment for graphitization immediately after hot-rolling, or by solution heat treatment after hot rolling, air cooling, and further heat treatment for graphitization.

In particular, in the case of a high Zr content and heat treatment for graphitization at a high temperature, a dispersed fine spherical graphite structure can be obtained in a relatively short period of time. Also in this case, heat treatment for graphitization can be performed at a relatively low temperature by controlling the Zr concentration and heat treating time.

Furthermore, the present invention provides the feature of depositing fine ZrC in the matrix, and forming dispersed fine graphite particles in an extremely short time by quenching after solution heat treatment.

As described above, according to the present invention, a medium-carbon steel comprising a dispersed fine spherical graphite structure is provided. The medium-carbon steel is recyclable, has high productivity, and has high mechanical strength, good processability and machinability. In addition, a method for manufacturing such a medium-carbon steel is provided by allowing fine ZrC particles to function as the nucleation sites of graphite and by dispersing fine graphite particles in a stable manner with high reproducibility.

What is claimed is:

1. A medium-carbon steel comprising a dispersed fine spherical graphite structure containing 0.1 to 1.5% Si, 1.0% or less of C, and 0.01% to 0.5% Zr, said structure is a matrix having graphite particles dispersed therein, wherein fine ZrC particles of about 1 $\mu$m or less are located adjacent said graphite particles and, during graphitization, provided nucleation sites from which said graphite particles formed.

2. A medium-carbon steel according to claim 1, wherein said graphite particles have an average diameter of 1 to 20 $\mu$m.

3. A medium-carbon steel according to claim 2, wherein 30 to 6500/mm$^2$ of graphite particles having an average diameter of 1 to 20 $\mu$m are dispersed in said matrix.

4. A medium-carbon steel according to claim 3, wherein cementite disappears and wherein graphite particles are dispersed in a ferrite matrix of said structure of said medium-carbon steel.

5. A medium-carbon steel according to claim 1, wherein cementite disappears and wherein graphite particles are dispersed in a ferrite matrix of said structure of said medium-carbon steel.

6. A method for manufacturing a medium-carbon steel comprising the step of:

heat-treating a material of a medium-carbon steel composition having a matrix containing 0.1 to 1.5% Si, 1.0% or less of C, and 0.01 to 0.5% Zr at a temperature of 750 to 1300° C. for 0.5 to 10 hours; and quenching said material in water, after said heat-treating step, to deposit fine ZrC particles in said matrix.

7. A method according to claim 6, wherein said graphitization treatment is performed at a temperature of 450 to 700° C.

8. A method for manufacturing a medium-carbon steel having a dispersed fine spherical graphite structure comprising the step of:

hot-rolling a material of a medium-carbon steel composition containing 0.1 to 1.5% Si, 1.0% or less of C, and 0.01 to 0.5% Zr;

air cooling said hot-rolled material; and heat treating said material at a temperature of 740° C. or below for 0.5 to 100 hours, after said cooling step, to provide a graphitization treatment to said material to grow graphite.

9. A method according to claim 8, wherein said graphitization treatment is performed at a temperature of 450 to 700° C.

10. A method for manufacturing a medium-carbon steel having a dispersed fine spherical graphite structure comprising the step of:

hot-rolling a material of a medium-carbon steel composition containing 0.1 to 1.5 % Si, 1.0% or less of C, and 0.01 to 0.5% Zr;

heat-treating said material, after said hot-rolling step, at a temperature of 750 to 1300° C. for 0.5 to 10 hours;

air cooling said hot-rolled material, after said heat-treating step; and heat treating said material at a temperature of 740° C. or below for 0.5 to 100 hours, after said cooling step, to provide a graphitization treatment to said material to grow graphite.

11. A method according to claim 6, further comprising the step of heat treating said material at a temperature of 740° C. or below for 0.5 to 100 hours, after said quenching step, to provide a graphitization treatment to said material to grow graphite using ZrC as nucleation sites.

12. A method according to claim 11, wherein said graphitization treatment is performed at a temperature of 450 to 700° C.

13. A medium-carbon steel prepared by a process comprising the steps of forming a dispersed fine spherical graphite structure containing 0.1 to 1.5% Si, 1.0% or less of C, and 0.01% to 0.5% Zr, and utilizing fine ZrC particles as graphite nucleation sites in said structure.

* * * * *